US007980453B2

(12) United States Patent
Hall

(10) Patent No.: US 7,980,453 B2
(45) Date of Patent: Jul. 19, 2011

(54) APPARATUS AND METHOD FOR HANDLES INTEGRATED WITH PRODUCT CONTAINERS

(75) Inventor: George M. Hall, Dallas, TX (US)

(73) Assignee: Poly-America, L.P., Grand Prairie, TX (US)

( * ) Notice: Subject to any disclaimer, the term of this patent is extended or adjusted under 35 U.S.C. 154(b) by 0 days.

(21) Appl. No.: 11/859,480

(22) Filed: Sep. 21, 2007

(65) Prior Publication Data

US 2009/0078751 A1 Mar. 26, 2009

(51) Int. Cl.
*B65D 5/46* (2006.01)

(52) U.S. Cl. ..... 229/117.13; 229/117.12

(58) Field of Classification Search ..... 229/117.12, 229/117.13, 117.14, 117.15; 206/141, 427
See application file for complete search history.

(56) References Cited

U.S. PATENT DOCUMENTS

| | | | | |
|---|---|---|---|---|
| 2,795,368 | A * | 6/1957 | Caster et al. | 229/117.12 |
| 2,955,739 | A * | 10/1960 | Collura | 229/117.13 |
| 4,378,905 | A * | 4/1983 | Roccaforte | 229/117.12 |
| 4,582,199 | A * | 4/1986 | Schuster | 206/427 |
| 5,639,017 | A * | 6/1997 | Fogle | 229/117.14 |
| 5,738,273 | A * | 4/1998 | Auclair | 229/117.13 |
| 6,848,573 | B2 * | 2/2005 | Gould et al. | 206/141 |
| 6,899,221 | B2 | 5/2005 | Skolik et al. | |
| 6,905,066 | B2 * | 6/2005 | Holley et al. | 229/117.13 |
| 6,926,193 | B2 * | 8/2005 | Smalley | 229/117.13 |
| 6,971,572 | B2 * | 12/2005 | Ikeda | 229/117.13 |
| 7,007,836 | B2 | 3/2006 | Smalley | |
| 7,178,712 | B2 | 2/2007 | Schultz et al. | |
| 2005/0167476 | A1 * | 8/2005 | Ikeda | 229/117.13 |

FOREIGN PATENT DOCUMENTS

| | | | | |
|---|---|---|---|---|
| JP | 5-147642 | A * | 6/1993 | 229/117.12 |

* cited by examiner

*Primary Examiner* — Gary E Elkins
(74) *Attorney, Agent, or Firm* — Brandon J. Lee

(57) ABSTRACT

The present invention is a handled container for retail products. The handled container defines an upper opening wherein a first upper panel and a second upper panel together cover a substantial portion of the upper opening. The second upper panel is provided with a pair of substantially parallel cuts extending across the second upper panel to define a handle in the second upper panel. A first upper panel is shaped such that it provides access to the handle when the first upper panel is positioned above the second upper panel and both are in the closed position to substantially seal the handled container.

10 Claims, 5 Drawing Sheets

APPARATUS AND METHOD FOR HANDLES INTEGRATED WITH PRODUCT CONTAINERS

CROSS-REFERENCE TO RELATED APPLICATIONS

Not applicable.

BACKGROUND OF THE INVENTION

1. Field of the Invention

The present invention relates generally to retail product containers having a handle for easy transport. More particularly, the present invention relates to a retail product container that provides a handle integrated into a product container.

2. Description Of The Related Art

Retail product containers are available in a variety of different forms and can be manufactured using many different types of material. One of the most common materials used for manufacture of product packaging is cardboard, which is relatively inexpensive. Furthermore, by providing a particular set of cuts and folds, the cardboard blank can be easily assembled into a wide variety of configurations. Cardboard is a strong and durable material, making it desirable for retail product containers, which must endure the rigors of transport and retail sale. As a result, cardboard is a commonplace material used in packaging of a wide variety of different retail products.

Even though cardboard can be used to provide a retail product container for a vast array of retail products, as the weight of the product increases the consumer may have difficulty in carrying the packaged product. Therefore, prior art solutions have been known to provide one or more handles incorporated into retail product containers, especially containers manufactured from cardboard. These handles make the transport and carrying of the retail products much easier.

The simplest solution for providing a handle in a container is to cut one or more holes or openings into the top or sides of a cardboard container to provide handles. This allows a person to insert his or her hands into the holes to hold, support, and carry the container. However, this solution can be problematic, as it permits a person to touch or contact the interior contents of the container. This subjects the product to potential tampering. Furthermore, in many situations, the size or configuration of the container may make positioning of one or more handles impracticable, such as when a pair of cut-outs are spaced at distances that do not allow a person to carry the container normally.

Other handle solutions involve the use of plastic handles that either attach to the exterior of the box or are partially integrated into the assembled box. The plastic handle connected to the exterior of the box is one simple design known in the prior art. It entails providing a plastic handle with its respective ends affixed or installed onto opposing side walls of the retail product container. The plastic handle extends upward, above the top of the box, allowing a consumer to carry the container with little difficulty. Unfortunately, because the plastic handle is pre-installed on the exterior of the retail product container, it makes regular, box-shaped containers more difficult to stack onto one another, as the plastic handle gets in the way. Therefore, it would be desirable to provide a handle for a retail product container that does not interfere with other containers or otherwise extend beyond the ordinary dimensions of the container when stacked.

Other prior art solutions integrate simple or complex plastic handle inserts or assemblies into the container walls or into one or more upper flaps. For example, one simple solution is to provide a plastic strap that is loosely provided on the upper surface of a first upper flap. A second upper flap is provided with a hole so that when the second upper flap is folded over onto the first upper flap, the hole provides access to the plastic strap which may be used as a handle. Other configurations utilize plastic handle assemblies integrated into the product packaging. However, all of these configurations have the disadvantage of requiring a complex, and costly, manufacturing process and incorporate multiple materials, i.e. cardboard and plastic. It would be advantageous to provide a handle solution for a cardboard container that does not require the utilization of a plastic strap to act as a handle. Furthermore, it would be advantageous to provide a handle configuration that is tamper-resistant.

SUMMARY OF THE INVENTION

The following description and the appended drawings set forth in detail certain illustrative embodiments of the present invention. These embodiments are only exemplars of some of the various ways in which the principles of the present invention may be employed. Therefore, this disclosure provides an outline, in rather broad terms, of the features of the invention in order that the detailed description thereof that follows may be better understood, and in order that the present contribution to the art may be better appreciated.

Embodiments of the present invention provide a handled container for products wherein the container generally has an upper opening and at least a first and second upper flap for closing the opening. The upper opening defines an upper edge. A pair of substantially parallel cuts are provided in at least one of the upper panels such that they extend across a substantial portion of the panel to define a handle. Another upper panel is used to cover the remaining portion of the upper opening and provide access to the handle.

Other embodiments of the present invention may also include a third upper panel provided below the handle. In any of the embodiments contemplated the panels may be provided as connected to the container, especially along the upper edge of the upper opening. Yet other embodiments of the present invention may be provided with a reinforcing member extending along the longitudinal axis of the handle and affixed thereto. Other embodiments may provide one or more side flaps that are inserted into the interior of the container. In yet other embodiments of the present invention, one upper panel is provided with a cut-out hole to provide access to the handle when in the closed position.

BRIEF DESCRIPTION OF THE DRAWINGS

The preceding summary of the invention, and the following detailed description of the drawings, are intended to provide a better understanding of the general principals and concepts of the present invention when viewed with reference to the preferred embodiments depicted in the drawings. It is understood that the present invention is not limited to the particular embodiments and precise arrangements disclosed herein. Rather, the appended claims are intended to more accurately describe the scope of the present invention. Furthermore, the drawings are not necessarily to scale, with emphasis instead being placed upon clearly illustrating the principles of the present invention. Finally, the drawings are provided with various reference numerals, with like reference numerals designating corresponding parts throughout the several views.

DETAILED DESCRIPTION OF THE INVENTION

The following discussion is presented to enable a person skilled in the art to make and use the present invention. The general principles described herein may be applied to numerous embodiments, including applications other than those detailed below, without departing from the spirit and scope of the present invention. The present invention is more generally defined by the appended claims. Therefore, the present invention is not intended to be limited to the embodiments shown, but is to be accorded the widest scope consistent with the principles and features disclosed herein in view of the prior art.

Figure 1A:
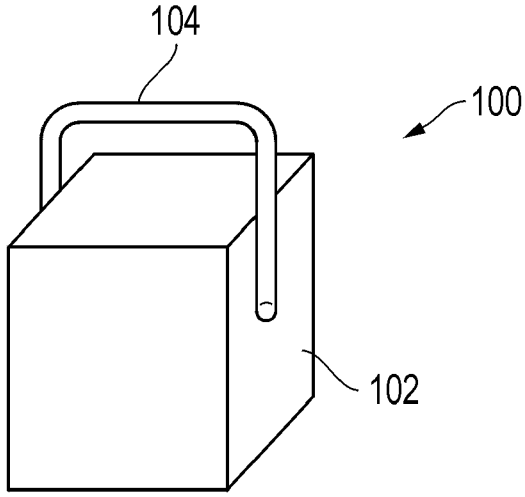
FIG. 1A (Prior Art)
FIG. 1A illustrates a type of prior art packaging that provides a handle by utilizing an externally installed plastic strap to serve as a handle.

Referring first to FIG. 1A, a prior art solution for providing a handle for retail product containers is depicted. The prior art handled container 100 is an ordinary cardboard container 102 provided with a plastic handle 104. The plastic handle 104 in this embodiment is a plastic strap, with the respective ends of the plastic strap affixed to opposite side walls of the cardboard container 102. After the plastic handle 104 is securely affixed, it can then be used to carry the container 102. However, because the handle is located on the exterior of the container 100, it prevents efficient stacking of the product and thus takes up extra space in merchandising and transportation.

Figure 1B:
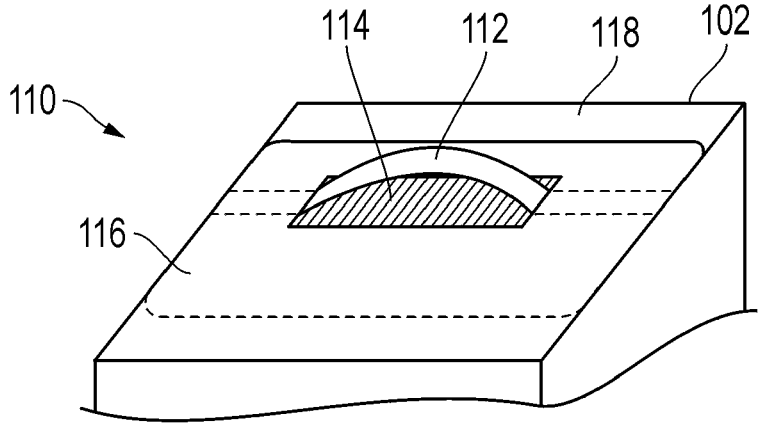
FIG. 1B (Prior Art)
FIG. 1B illustrates a second type of prior art product container that utilizes a plastic strap positioned between the pair of opposing top flaps.

Referring now to FIG. 1B, a second prior art solution is depicted. In this case, a container with an integrated handle 110 is depicted. The cardboard container 102 is provided with a plastic handle insert 112 on the first upper flap 118 of the corrugated cardboard box 102. The second upper flap 116 of the corrugated cardboard box 102 is provided with a hole 114, which allows access to the plastic handle insert 112. However, like the embodiment depicted in FIG. 1A, this embodiment requires the use of an additional plastic component which can increase both the material cost and the complexity for manufacturing the container 110.

Figure 2:
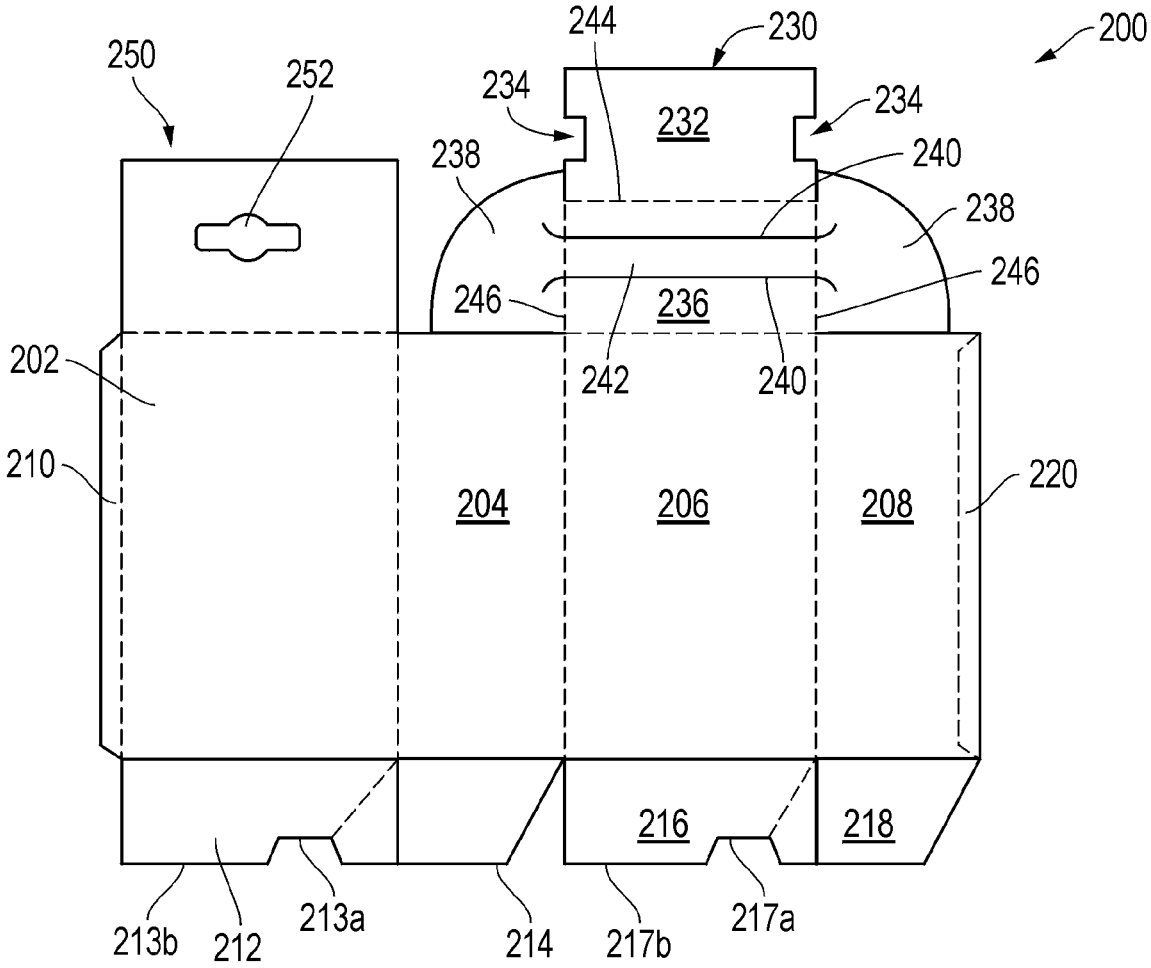
FIG. 2 depicts a cardboard blank for a product container according to an embodiment of the present invention.

Referring now to FIG. 2, an unassembled cardboard blank 200 is depicted as would be utilized for one embodiment of the present invention. The assembled container will be better illustrated with respect to FIGS. 3-6. The solid lines of FIG. 2 indicate through-cuts of the cardboard blank 200, while the dashed lines are locations where the cardboard blank 200 is folded for assembly. The cardboard blank 200 has a front panel 202, a first side panel 204, a back panel 206, and a second side panel 208. Also, the front panel 202 is provided with a short tab 210 running the length of the front panel 202 for securing the front panel 202 to the second side panel 208 at area 220. After assembly, the four panels 202, 204, 206, 208 form a generally rectangular outer wall of the cardboard container described below.

Each side panel is also provided with a bottom portion 212, 214, 216, and 218. A person having ordinary skill in the art would understand that these bottom panels are folded inward during assembly to provide the bottom of the cardboard container. In particular, cutout 213*a* engages portion 217*b* and cutout 217*a* engages portion 213*b* to generally lock the bottom panels 212, 214, 216 and 218 into position. A person having ordinary skill in the art would recognize that numerous other configurations could be utilized to provide a bottom for a cardboard container according to the present invention, and the depicted configuration is purely for illustrative purposes. It is also contemplated that the present invention may be utilized with any shaped container, including an irregularly shaped container, with an opening that allows it to be covered with one or more upper panels, or flaps.

Figure 3:
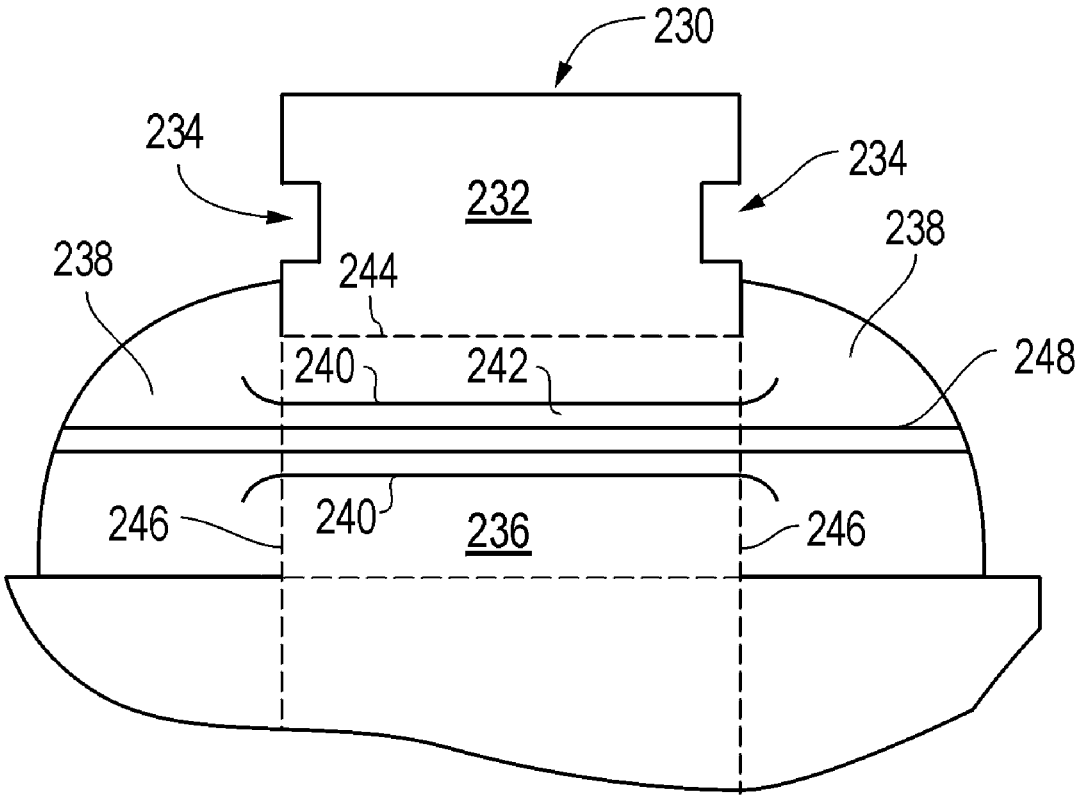
FIG. 3 depicts a slight modification of the first top flap according to an embodiment of the present invention.
Figure 4:
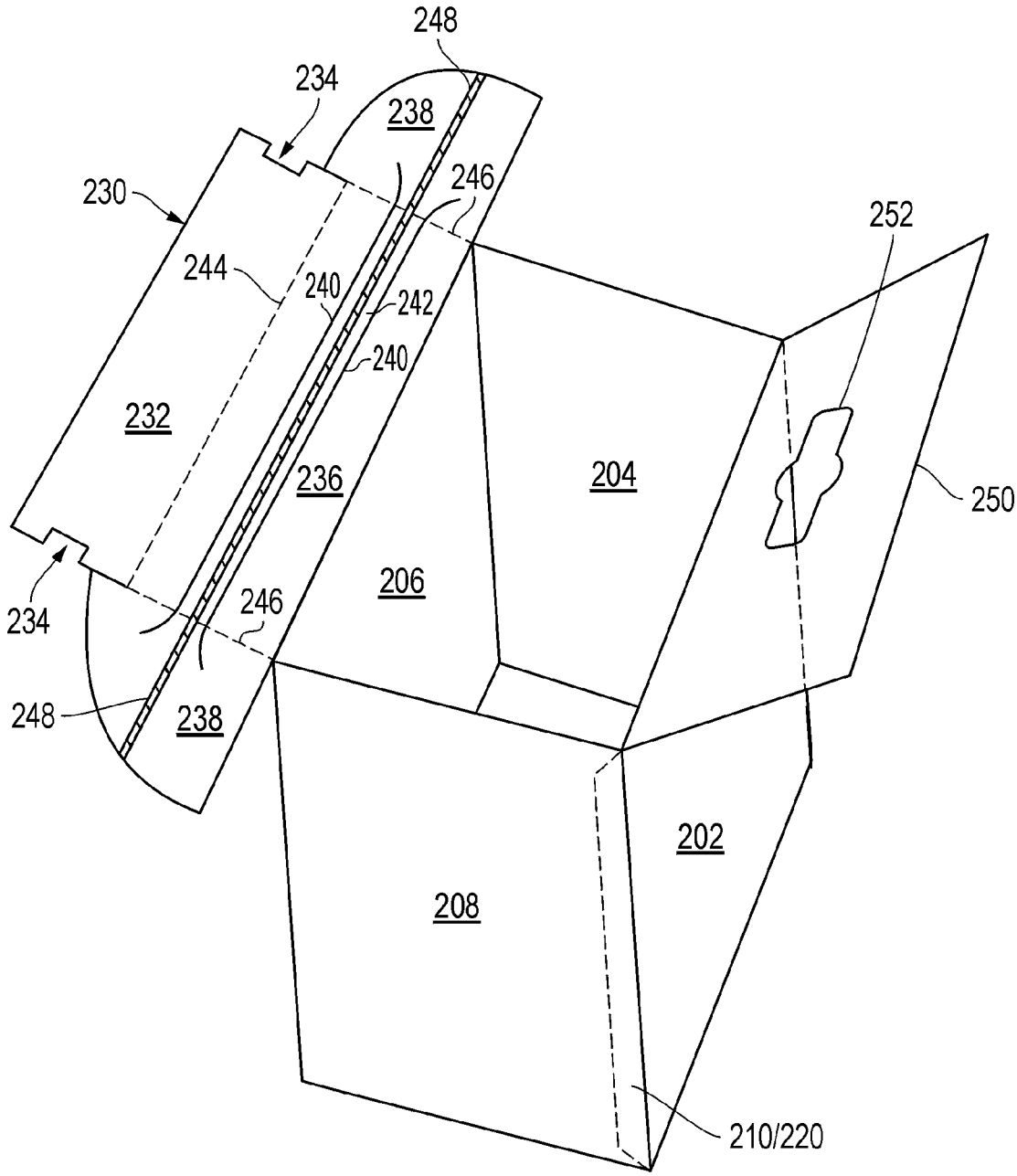
FIG. 4 provides a perspective view of the partially assembled product container previously depicted in FIGS. 2 and 3.

Referring now to FIGS. 2, 3, and 4, the aspects of the present invention are best seen with respect to the first upper flap 230 and the second upper flap 250. The first upper flap 230 is composed of several individual folding panels 232, 236, and 238. In a preferred embodiment, panel 232 is the bottom panel upon final assembly of the box. The cutouts 234 of panel 232 allow the handle to extend beyond the upper surface of the box as will be better illustrated in later figures.

Panel 236 will be sandwiched, upon assembly, between panel 232 and the second upper flap 250. In particular, panel 232 is folded back and behind panel 236 along line 244. Panel 236 is also provided with two parallel through-cuts 240 extending along the length of panel 236 to form the handle 242. The two side panels 238 are folded back along lines 246, and into the upper opening of the box, so as to be positioned immediately adjacent and inside side panels 204 and 208. FIGS. 3 and 4 also illustrate a reinforcing band 248 which may be affixed to the underside of the handle 240 to provide additional strength to the corrugated cardboard handle 242. Generally, the reinforcing band 248 is affixed into position prior to assembly and can be manufactured from a variety of strong, yet inexpensive materials.

Figure 5:
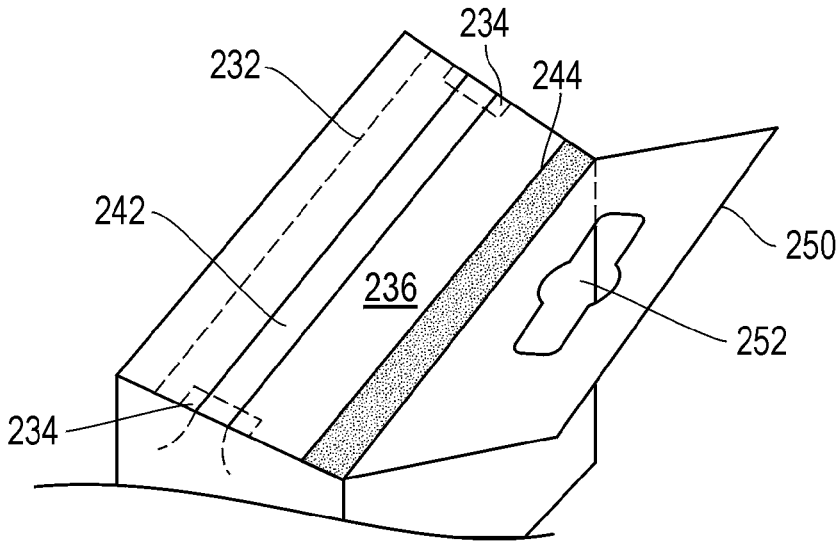
FIG. 5 depicts the upper portion of the product container of FIG. 4 with the first flap folded once onto itself.
Figure 6:
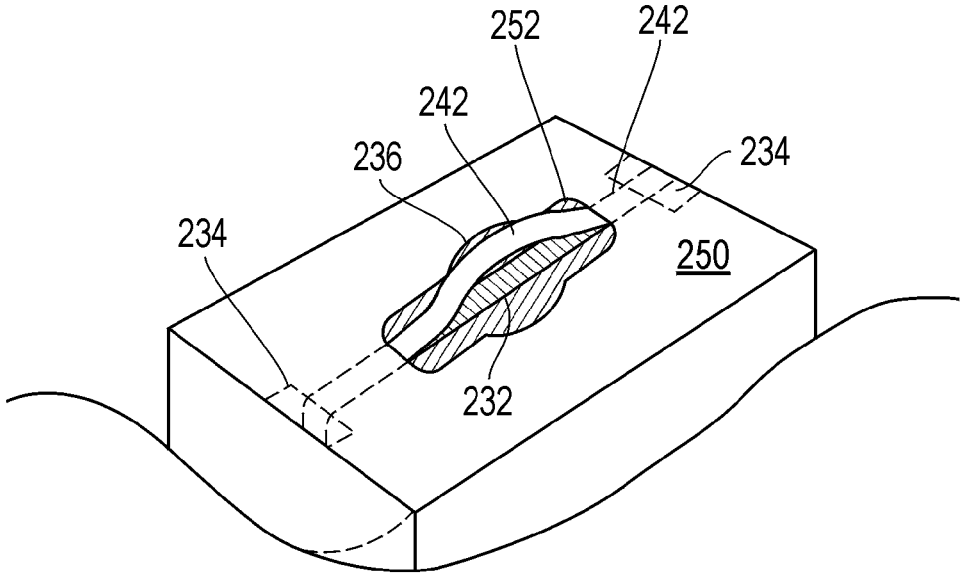
FIG. 6 depicts the final step in providing a product container according to one embodiment of the present invention.

Referring now to FIGS. 5 and 6, the assembly of the top flaps of the corrugated card board box is better illustrated. As can be seen, panel 232 has been folded down and around fold line 244 and terminates approximately where the dashed lines run across panel 236. Side panels 238 have already been positioned inside the corrugated cardboard box and rest against the side panels 204 and 208. It can also be seen that the cutouts 234 of panel 232 are positioned to correspond with the handle 242 cut out of panel 236. This allows the handle 242 to be pulled up through the hole 252 provided in the second upper flap 250.

The final configuration depicted in FIG. 6 illustrates the final relationship between the various panels. In particular, the second upper flap 250 generally covers panel 236 of the first upper flap 230. The hole 252 in the second upper flap 250 allows a person to access the handle 242. As can be seen, the rest of panel 236 prevents a person from accessing the product through the hole 252. Furthermore, where the handle 242 was cut out of panel 236, panel 232 prevents a person from tampering with the retail product contained within the container. The cutouts 234 of panel 232 prevent the handle 242 from extending more than a short distance when pulled through the hole 252.

What is claimed is:

1. A handled container for products, comprising:

an upper opening defining an upper edge;

a first upper panel hingedly connected to a first side of the upper edge, the first upper panel covering at least a portion of the upper opening when in a closed position;

a second upper panel hingedly connected to a second side of the upper edge, the second side of the upper edge generally opposite the first side of the upper edge, the second upper panel covering at least a portion of the upper opening when in a closed position, wherein the second upper panel comprises a pair of substantially parallel cuts extending across the second upper panel, the substantially parallel cuts being parallel to the second side of the upper edge and wherein the pair of substantially parallel cuts define a handle with end portions adjacent ends of the second upper panel; and a third upper panel hingedly connecting to the second upper panel opposite the second side of the upper edge hingedly connected to the second upper panel, the third upper panel covering at least a portion of the upper opening and located below the second upper panel when in a closed position, wherein the first upper panel further comprises a hole in the first upper panel to allow exterior access to the second upper panel when the first upper panel and the second upper panel are in a closed position, wherein the third upper panel is positioned under the second panel when in the closed position and wherein said end portions of said handle being sandwiched between upper end portions of said first panel adjacent said hole and lower end portions of said third panel when in the closed position such that the third upper panel limits extension of the handle of the second upper panel when the handle is pulled through the hole.

2. The container of claim 1, further comprising:

a reinforcing member affixed along a longitudinal axis of the handle.

3. The handled container of claim 1, further comprising a pair of side flaps connected to opposing edges of the second upper panel.

4. The handled container of claim 1, wherein the hole for providing access to the handle has a length that is less than a length of the pair of substantially parallel cuts.

5. The handled container of claim 1, wherein the container comprises:

a plurality of substantially vertical walls; and a substantially horizontal bottom.

6. The handled container of claim 5 wherein the plurality of substantially vertical walls and the substantially horizontal bottom form a rectangular container having an upper opening that is rectangular in shape.

7. The handled container of claim 1, wherein a plurality of cutouts are located at opposite ends of the third upper panel.

8. The handled container of claim 1, wherein a plurality of cutouts are positioned to correspond with the handle.

9. The handled container of claim 1, wherein the distance the handle extends beyond the second upper panel is limited by a plurality of cutouts.

10. The handled container of claim 1, wherein the distance the handle extends is limited by a plurality of cutouts to a short distance.

* * * * *